US006321944B1

(12) United States Patent
Cetrangolo

(10) Patent No.: US 6,321,944 B1
(45) Date of Patent: Nov. 27, 2001

(54) DISPLAY APPARATUS FOR A COLLAPSIBLE TUBE DISPENSER

(76) Inventor: Edward M. Cetrangolo, 2210 Knight Rd., Land O'Lakes, FL (US) 34639

( * ) Notice: Subject to any disclaimer, the term of this patent is extended or adjusted under 35 U.S.C. 154(b) by 0 days.

(21) Appl. No.: 09/552,611

(22) Filed: Apr. 19, 2000

Related U.S. Application Data

(63) Continuation-in-part of application No. 09/233,304, filed on Jan. 19, 1999, now Pat. No. 6,135,322, which is a continuation-in-part of application No. 09/087,341, filed on May 29, 1998, now abandoned.

(51) Int. Cl.[7] ..... B65D 35/56

(52) U.S. Cl. ..... 222/105; 222/154; 222/192; 222/386.5; 206/459.5; 206/466

(58) Field of Search ..... 222/78, 92, 105, 222/107, 154, 192, 386.5; 206/459.5, 461, 466

(56) References Cited

U.S. PATENT DOCUMENTS

| | | |
|---|---|---|
| 1,869,594 | 8/1932 | Johnston . |
| 2,535,671 | 12/1950 | Cutler . |
| 2,551,176 | 5/1951 | Smith . |
| 2,564,359 | 8/1951 | Fuller . |
| 2,996,176 | 8/1961 | Sherman . |
| 3,022,920 | 2/1962 | Croom, Jr. . |
| 3,269,604 | 8/1966 | Serry . |
| 3,313,455 | 4/1967 | Kemmer . |
| 3,455,440 | 7/1969 | West . |
| 3,724,722 | 4/1973 | Ballo . |
| 3,746,156 | 7/1973 | Austin, Jr. . |
| 3,868,036 | 2/1975 | Wittwer . |
| 4,020,694 | 5/1977 | Mayhew . |
| 4,657,151 | 4/1987 | Cabernoch . |
| 5,115,948 | 5/1992 | Johnson . |
| 5,143,215 | 9/1992 | Hartley . |
| 5,275,311 | 1/1994 | Piarrat . |
| 5,332,121 | 7/1994 | Schmidt et al. . |
| 5,447,255 | 9/1995 | Smedley . |
| 5,655,684 | 8/1997 | Krall . |
| 6,135,322 * | 10/2000 | Cetrangolo ..... 222/105 |

* cited by examiner

*Primary Examiner*—Joseph A. Kaufman
(74) *Attorney, Agent, or Firm*—Larson & Larson, P.A.; James E. Larson

(57) ABSTRACT

A flexible transparent polymeric sleeve encloses toiletry items or a collapsible tube dispenser. The sleeve is closed at one end where it is integral with a hanger element and open at its other end where an external annular ring can be employed to maintain the opening in the sleeve. A sleeve cap closes the sleeve opening and engages a paste dispensing element of the collapsible tube dispenser. The sleeve cap includes a base portion integrally attached to a cap portion by a hinge. A center channel formed within the sleeve cap base portion axially aligns with paste dispensing element and permits paste to flow from the collapsible tube through the center channel and out an open end. A flexible polymeric support member consisting of at least one panel supports a picture or indicia. The support member is mounted longitudinally within the polymeric sleeve. A structure to release air can be included in a bottom portion of the polymeric sleeve.

21 Claims, 8 Drawing Sheets

DISPLAY APPARATUS FOR A COLLAPSIBLE TUBE DISPENSER

PRIOR APPLICATIONS

This application is a continuation-in-part of application Ser. No. 09/233,304, filed on Jan. 19, 1999, and allowed on Feb. 8, 2000, now U.S. Pat. No. 6,135,322, which is a continuation-in-part of Ser. No. 09/087,341 filed on May 29, 1998, now abandoned.

BACKGROUND OF THE INVENTION

1. Field of Invention

This invention relates to a display apparatus for use with collapsible tubes for dispensing paste products. More particularly, it refers to a clear jacket or sleeve for enclosing a squeezable tube dispenser, the jacket containing interior panels for displaying pictures and indicia.

2. Description of the Prior Art

The prior art describes apparatus used with toothpaste dispensing tubes. U.S. Pat. No. 5,447,255, describes a toothpaste dispensing apparatus designed to enclose a disposable toothpaste tube and sequentially dispense toothpaste from the tube spout by operation of a pair of spring-loaded rollers. The apparatus includes a container having a pair of longitudinal slots, a removable cap and a toothpaste dispensing valve in the cap for registering with a threaded toothpaste tube spout and dispensing toothpaste from the tube spout on demand.

In U.S. Pat. No. 5,115,948, a toothpaste dispenser having a chamber is operated by a flexible bag extending longitudinally alongside the chamber. A one way valve is provided at the bottom of the chamber through which air, under pressure, is introduced when the bag is compressed manually. A toothpaste pusher inside the chamber is moved vertically upwardly by the air under pressure introduced through the one-way valve. The toothpaste pusher takes the form of a bellows.

U.S. Pat. No. 3,313,455 describes a resilient tubular housing for a collapsible tube. A loop member is mounted on the tail portion of the resilient tubular housing and is slidable on the tail portion.

U.S. Pat. No. 3,455,440 describes a covering for a collapsible capped tube made from sheet material with a window opening in a front panel to permit display of an article between the sheet material.

Although the prior art devices for enclosing a collapsible tube serve their intended purposes, no prior art device provides a covering for a collapsible tube that includes advertising or picture display elements together with the elements of applicant's display apparatus.

SUMMARY OF THE INVENTION

The present invention is directed towards a display apparatus for collapsible tube dispensers that can be used for displaying a plurality of permanent or removable objects and indicia thereon. Accordingly, it is a general object of this invention to provide a displaying apparatus that will allow a plurality of indicia or photographs to be exhibited on the surface of a collapsible tube dispenser.

Another object of this invention is to provide a displaying apparatus having a flexible-supporting member, the flexible-supporting member having the properties of memory, retention and enclosing indicia or photographs.

Yet another object of this invention is to provide a novel cap member having properties which permit it to mate with a plurality of different paste product dispensing collapsible tubes and permit the invention to stand on its end to continually display a picture or indicia.

BRIEF DESCRIPTION OF THE DRAWINGS

This invention, together with other objects, features, aspects and advantages thereof, will be more clearly understood from the following description, considered in conjunction with the accompanying drawings.

DETAILED DESCRIPTION OF THE INVENTION

Figure 1:
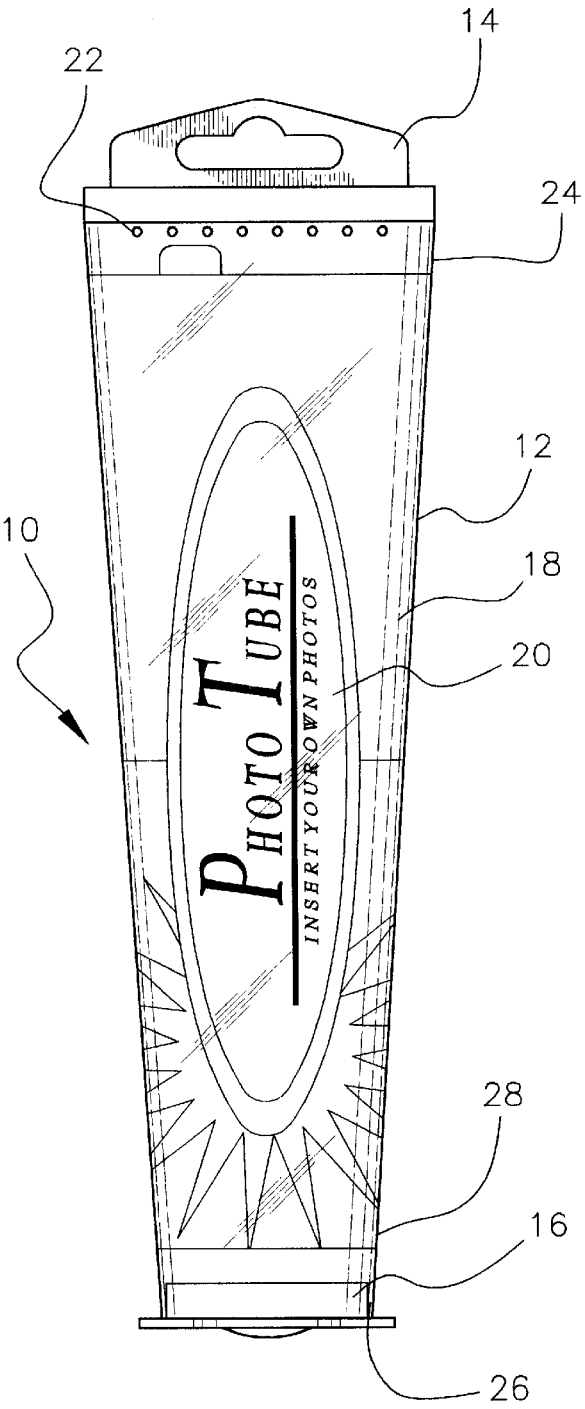
FIG. 1 is a front view of the tube dispenser display apparatus of this invention.

Throughout the following detailed descriptions, the same reference numerals refer to the same elements in all figures.

Referring to FIG. 1, a display apparatus of the invention 10 has an outer transparent sleeve 12 attached to a hanger element 14 and having a sleeve cap 16 enclosing the contents of the sleeve 12. Hanger element 14 is used as one means for displaying apparatus 10 in a vertical configuration, such that display apparatus 10 hangs on an outwardly extending rod (not shown) commonly seen in drugstore and supermarket displays. In such display arrangement, multiple units of display apparatus 10 can be hung on a single rod such that if a first unit is pulled off the rod, a second or subsequent unit is found directly therebehind.

Figure 3:
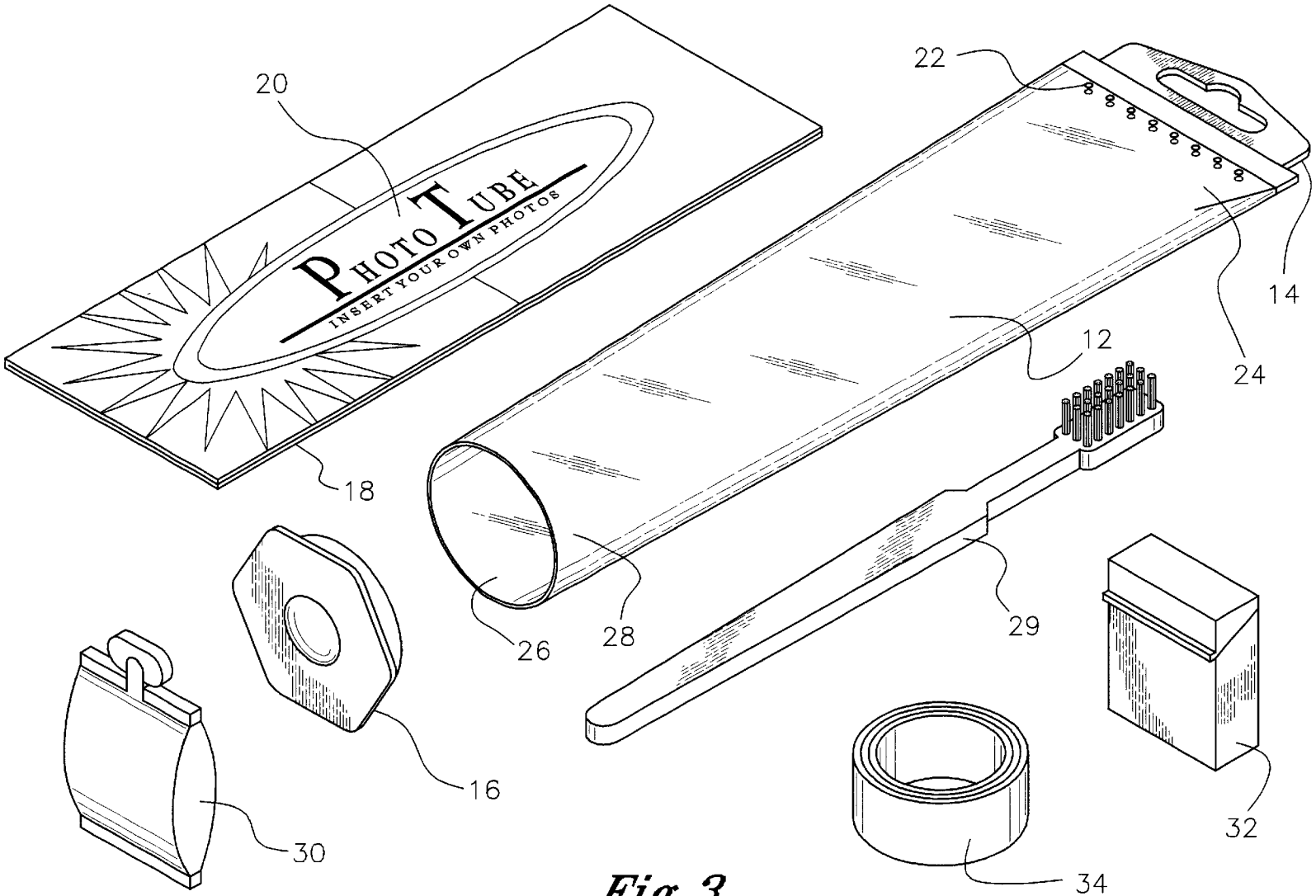
FIG. 3 is a perspective view of various toiletry components that can be inserted within the display apparatus.

Referring to FIG. 3, a flexible support member 18 is enclosed within sleeve 12 and contains a picture or indicia 20. Although not required, air release apertures 22 can be located in a rear portion 24 of sleeve 12. An alternate embodiment employs a check valve (not shown). Sleeve cap 16 encloses an opening 26 in a top portion 28 of sleeve 12.

Figure 2:
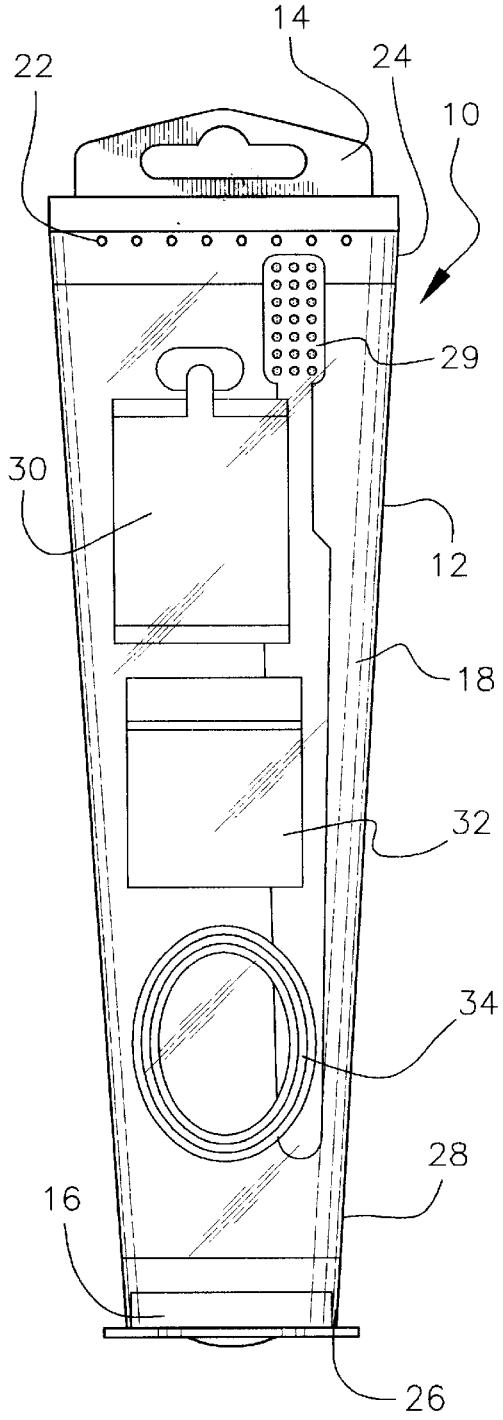
FIG. 2 is a rear view of the tube dispenser display apparatus containing sample toiletry items.
Figures 4, 5:
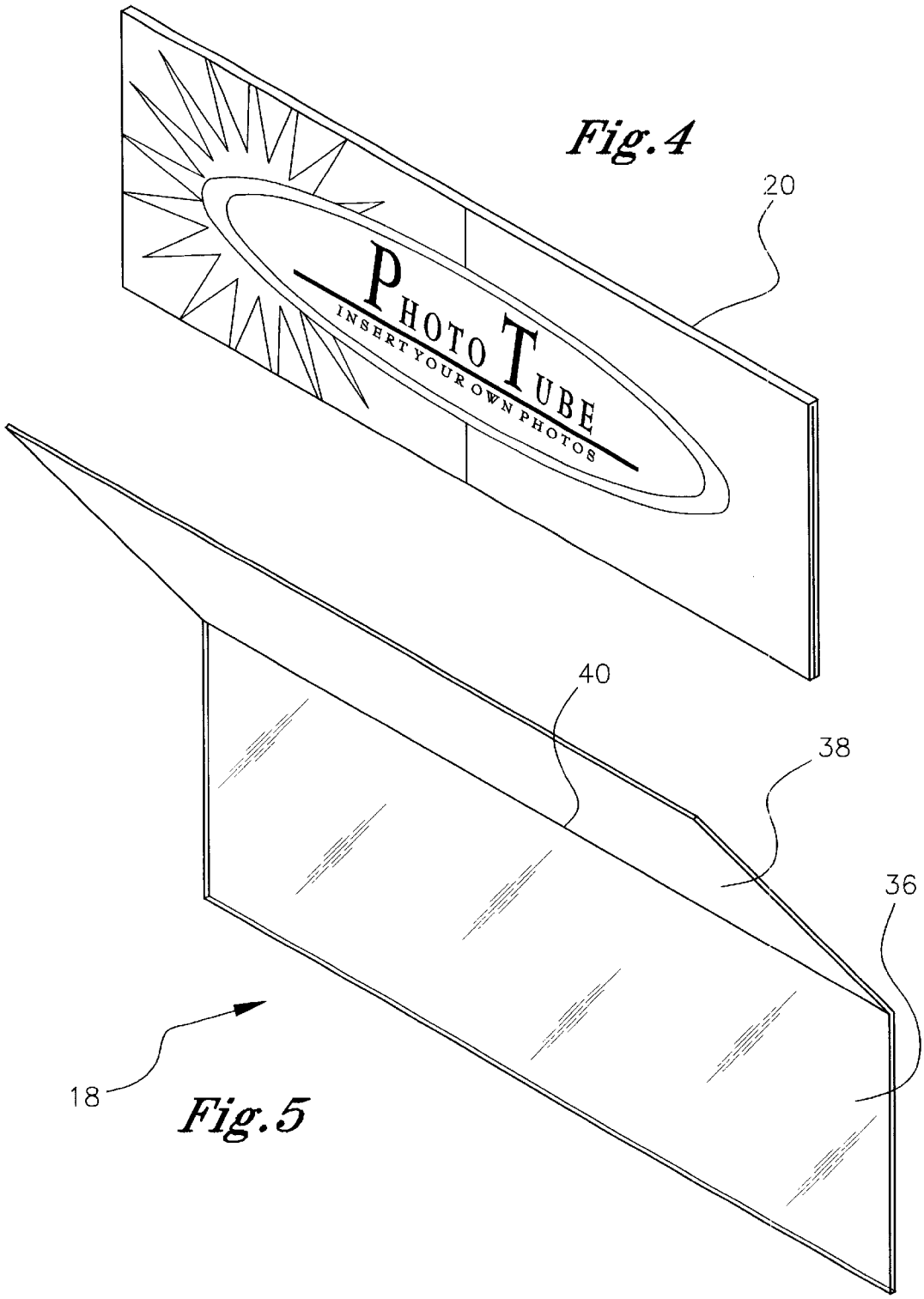
FIG. 4 is a perspective view of a photo or indicia sheet for enclosure with an internal supporting element.
FIG. 5 is a perspective view of the display apparatus internal supporting element.
Figure 14:
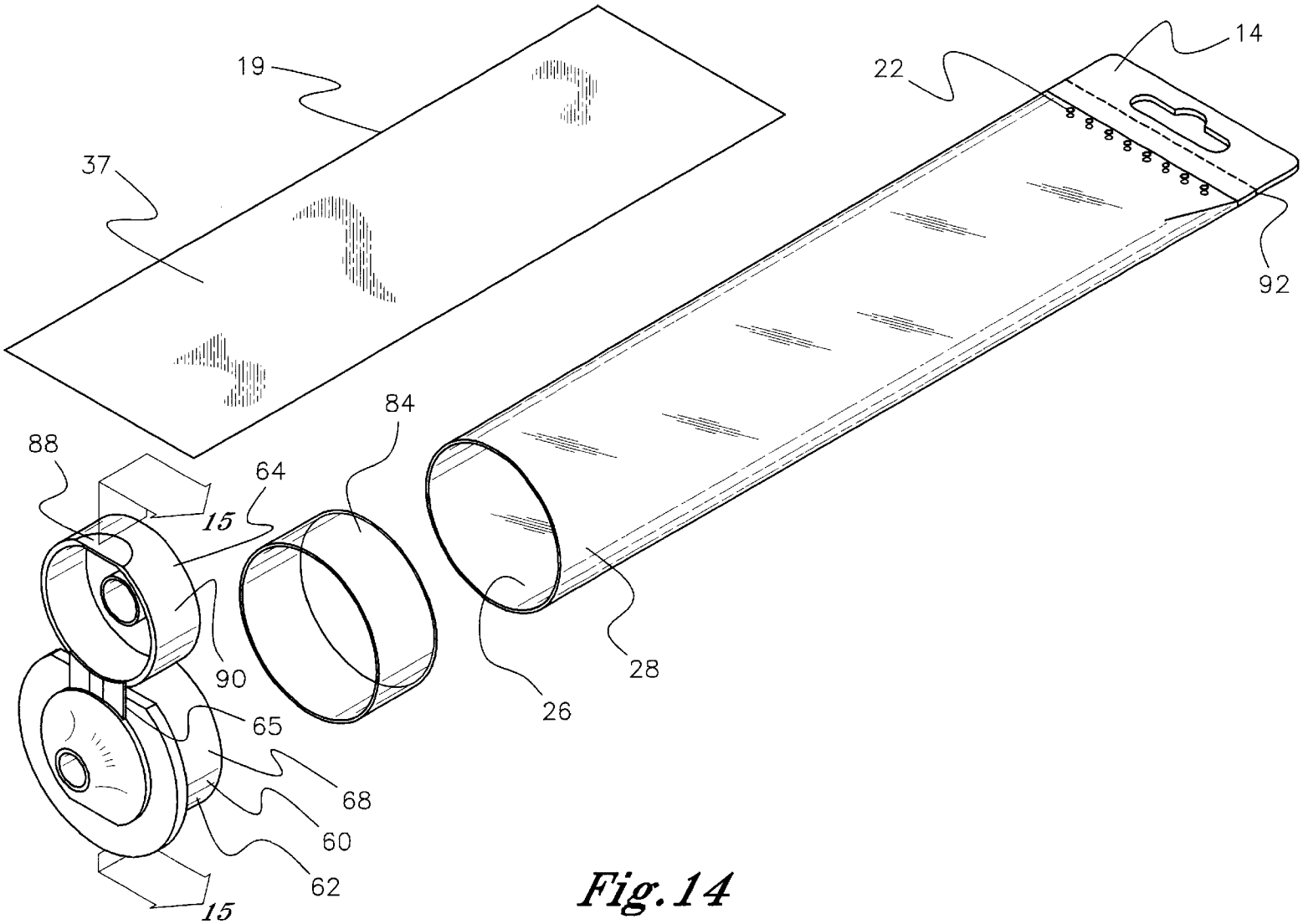
FIG. 14 is an exploded view of the alternate dispenser display apparatus.

Referring to FIG. 2, sleeve 12 in one mode contains toiletry items including a toothbrush 29, a small collapsible tube of toothpaste 30, a container of floss 32 and a flexible support ring 34 to be discussed hereafter. Flexible support member 18, shown in FIG. 5 in its preferred embodiment, contains two panels 36 and 38 foldable along crease line 40. As shown in FIG. 14 however, a single panel flexible support member 19 can also be employed. In the preferred embodiment, picture or indicia 20 is inserted between panels 36 and 38 prior to inserting support member 18 into opening 26 of sleeve 12. As to the preferred support member 18, at least one panel is opaque and at least a portion of the other panel is translucent to permit viewing of picture or indicia 20 between panels 36 and 38. Both panels 36 and 38 however could be translucent if desired. When alternate flexible support member 19 (seen in FIG. 14) is employed, picture or indica 20 is merely placed upon a top surface 37 of support member 19.

Figure 6:
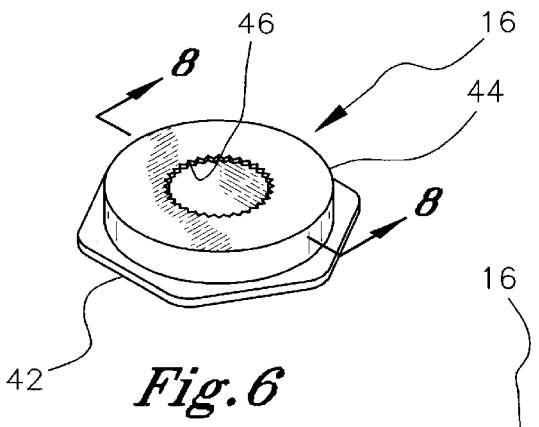
FIG. 6 is a perspective view of a display base for receipt of a collapsible tube cap.
Figure 7:
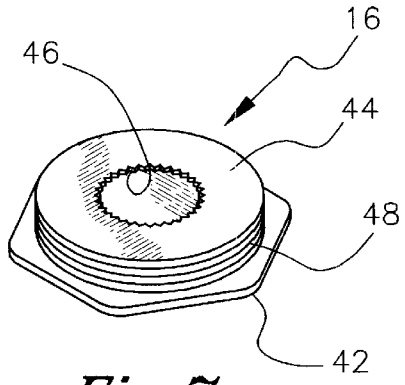
FIG. 7 is a perspective view of an alternate display base.
Figure 8:
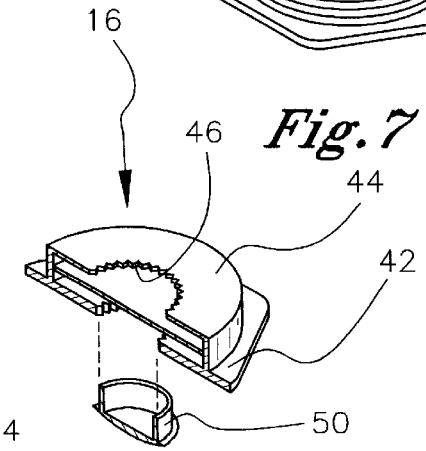
FIG. 8 is a cross-sectional view along lines 8—8 of FIG. 6.

Turning now to FIGS. 6–8, sleeve cap 16 has a hexagonal top 42 integral with an annular collar 44 enclosing a serrated inner opening 46. Alternatively, as seen in FIG. 7, sleeve cap 16, can have threads 48 on an exterior portion of collar 44 to engage opening 26 of sleeve 12. An insert 50 can plug serrated opening 46 when a toothpaste tube cap 52 (see FIG. 11) is not inserted into opening 46.

Figure 11:
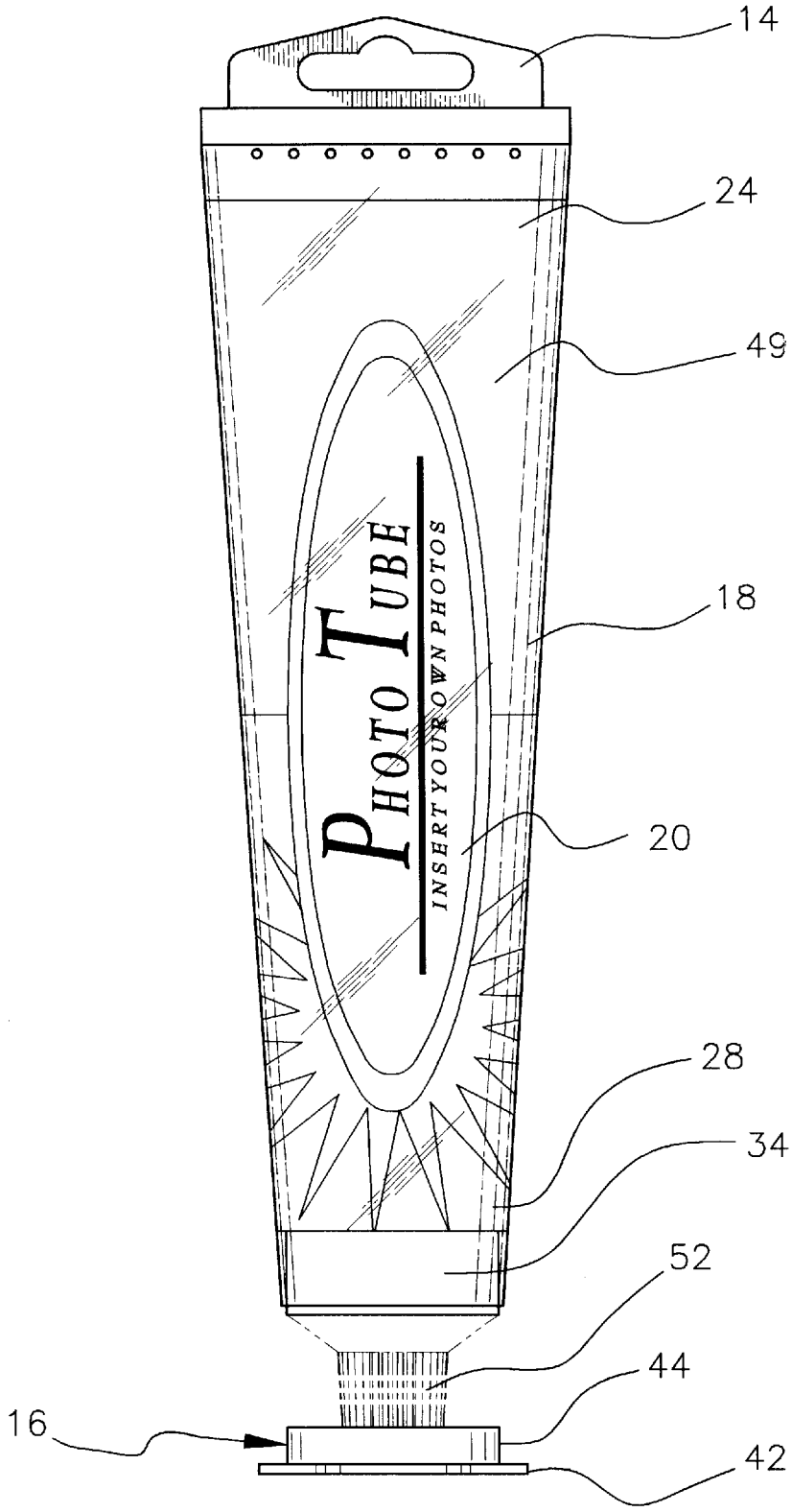
FIG. 11 is a front view of the displaying apparatus enclosing a collapsible tube with all its features set forth.
Figure 12:
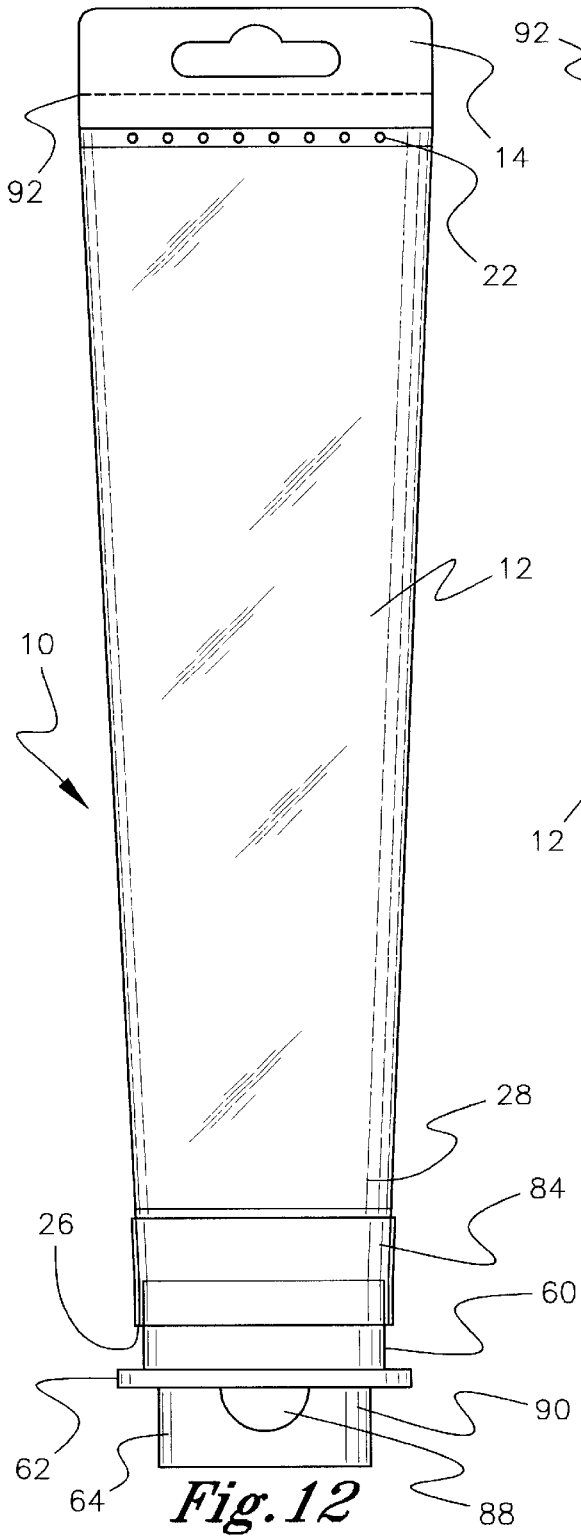
FIG. 12 is a front view of an alternate dispenser display apparatus of this invention having a novel cap member.
Figure 13:
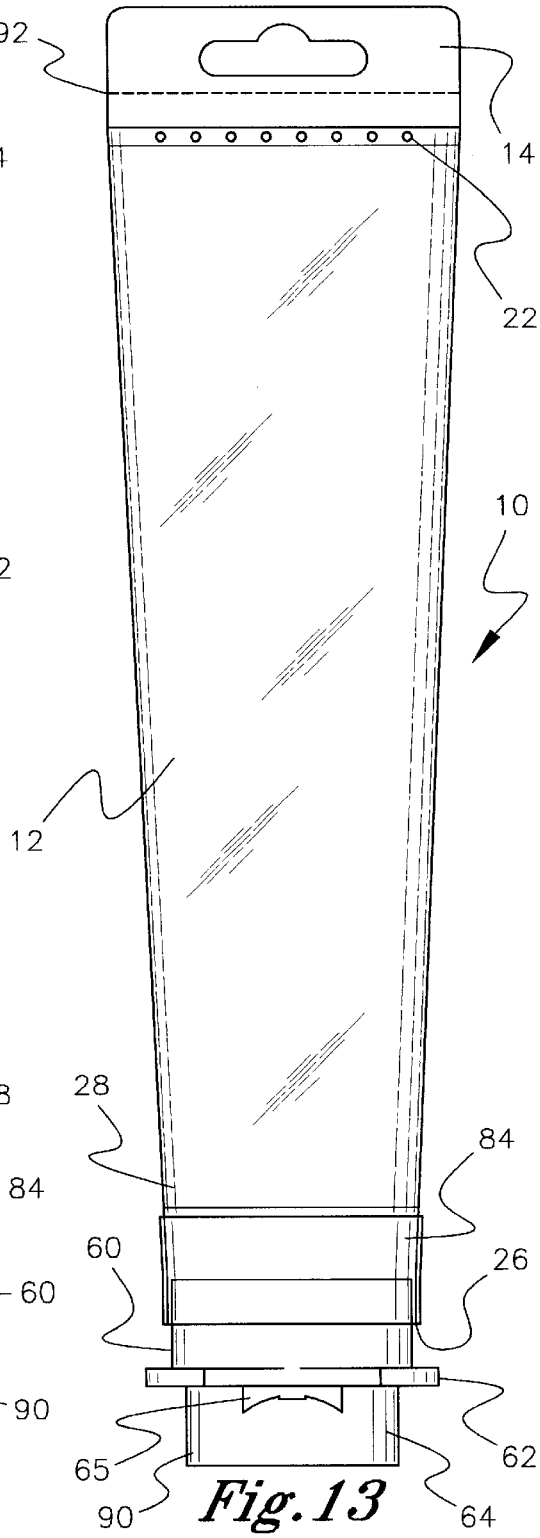
FIG. 13 is a rear view of the alternate dispenser display apparatus having the novel cap member.

When collapsible tube 49 is inserted into sleeve 12 as shown in FIG. 11, the sleeve cap 16 is used as a stand to support collapsible tube 49 inside sleeve 12. Cap 52 of collapsible tube 49 fits into opening 46 (seen in FIGS. 6–8) and collapsible tube 49 is supported in an upright vertical position by sleeve cap 16 when laid upon a generally flat surface. This enhances display of the picture or indicia 20 within sleeve 12.

Figure 9:
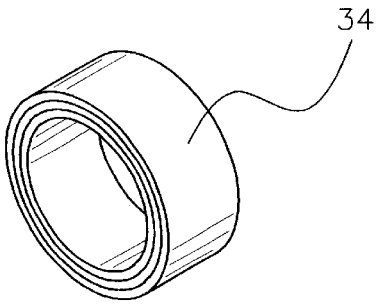
FIG. 9 is a perspective view of an internal support collar for use with the display apparatus.
Figure 10:
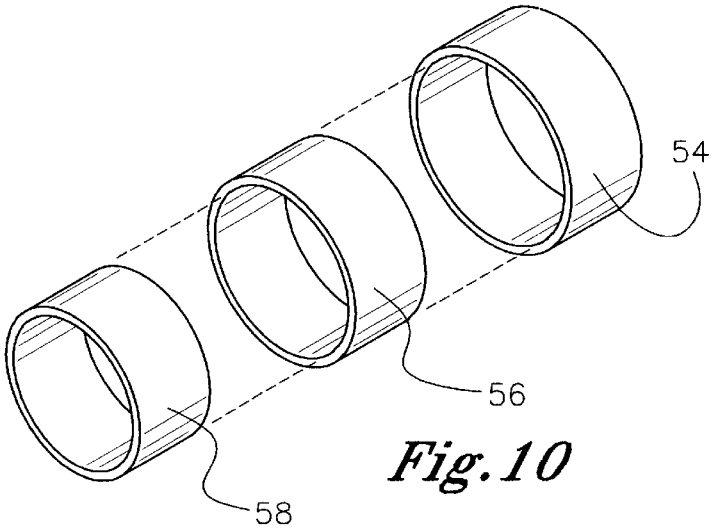
FIG. 10 is an exploded view of the internal support collar.

Referring to FIGS. 9–10, support ring 34, which includes a series of three rings 54, 56 and 58, is used to support opening 26 in sleeve 12. Depending on a diameter of opening 26 and a top circumference of collapsible tube 49 any one of support rings 54, 56 or 58 can be used to firmly mount collapsible tube 49 within sleeve 12.

Picture or indicia 20 is placed within flexible support element 18 or upon alternate support member 19. Support element 18 or 19 is then located longitudinally between an outside surface of collapsible tube 49 and an inner surface of sleeve 12.

Flexible sleeve 12 can be made of poly vinyl chloride, low density polyethylene or other suitable transparent polymer and is produced by known molding techniques. In like manner, supporting element 18 or 19 an be made of poly vinyl chloride or like material and can be opaque on one side and transparent on the other side to enhance display of the indicia or picture 20. Air release apertures 22 are employed to prevent air blockage at rear end 24 of sleeve 12.

Figure 15:
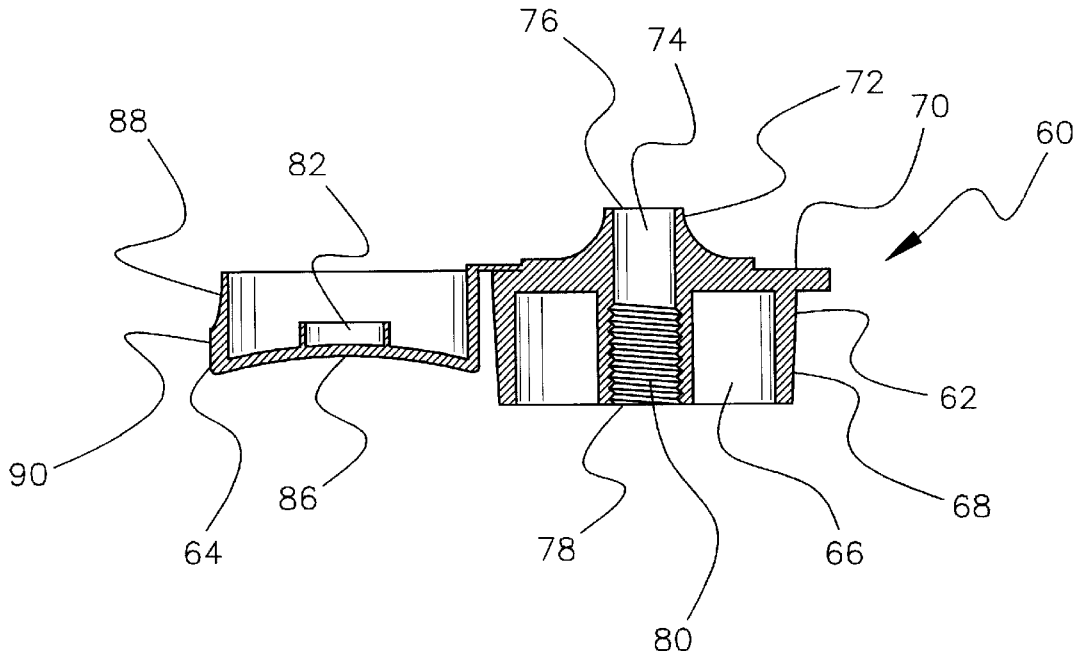
FIG. 15 is a cross-sectional view of the novel cap member along lines 15—15 of FIG. 14.

In an alternate embodiment, display apparatus 10 can include an alternate sleeve cap 60 as shown in FIGS. 12–15. Cap 60 includes a base portion 62 and a top portion 64 which rotates about a hinge 65 such that top portion 64 can engage base portion 62 to close cap 60. Base portion 62 and top portion 64 snap together by a friction fit. As shown in FIG. 14, cap 60 is generally circular-shaped. As shown in FIG. 15, cap 60 further includes an inner cavity 66, an annular collar 68, a top wall 70, an upwardly extending generally cone-shaped nipple portion 72 and a center channel 74 formed through inner cavity 66 having an open top end 76 and an open bottom end 78. Center channel 74 includes a threaded portion 80 disposed near open bottom end 78 for engaging an outer threaded portion (not shown) of a collapsible tube dispenser tip inserted within sleeve 12 when the tube dispenser has its threaded cap removed.

With continuing reference to FIG. 15, it is shown that alternate sleeve cap top portion 64 has an internal cap member 82 which axially aligns with center channel top end 76 when top portion 64 engages base portion 62. Since the paste of the tube dispenser inserted within sleeve 12, which in turn engages alternate sleeve cap 60, is dispensed through center channel 74, internal cap member 82 ensures that no paste leaks therefromout when alternate sleeve cap top portion 64 snaps to base portion 62.

Alternate sleeve cap annular collar 68 inserts within opening 26 of sleeve 12. Accordingly, in such embodiment, flexible support ring 34 is not needed. Although not shown, alternate sleeve cap annular collar 68 can be inwardly tapered to ensure a tight friction fit within opening 26. Although not needed, a flexible exterior support ring 84 can be inserted over an outer circumference of sleeve 12 at top portion opening 26 to provide additional support to the friction fit between alternate cap 60 and top portion opening 26. If used, flexible exterior support ring 84 would be inserted over the outer circumference of sleeve 12 at top portion opening 26 before sleeve cap 60 is inserted within opening 26.

As shown in FIG. 15, a small air gap is left between base portion 62 and cap portion 64 when rotated completely about hinge 65. Further, top portion 64 can include a concave-shaped top surface 86 for providing additional support to display apparatus 10 when positioned upright on a generally flat surface by alternate sleeve cap 60. Finally, as to alternate sleeve cap 60, a small indent 88 can be formed along an outer circumference 90 of top portion 64 providing a means for releasing top portion 64 from base portion 62 when engaged by its friction fit.

Display apparatus 10 can further include a series of perforated cuts 92 formed along a line perpendicular to that of a center axis running along the length of sleeve 12. Perforated cuts 92 permit hanger element 14 to be removed by tearing it therefrom.

Equivalent elements can be substituted for the elements employed in this invention to obtain the same results in the same manner.

Having thus described the invention what is claimed and desired to be secured by Letters Patent is:

1. A display apparatus for a collapsible tube dispenser having an openable paste dispensing element, the display apparatus comprising:

(a) a flexible transparent polymeric sleeve removably enclosing the collapsible tube dispenser, the sleeve having an open top end, a closed bottom end and a longitudinal axis running between the top and bottom ends, (b) a flexible polymeric support member having at least one panel removably positioned longitudinally within the sleeve, the support member providing a means for displaying indicia and pictures, and (c) a sleeve cap engaging the collapsible tube dispenser, the sleeve cap having a base portion and a top portion, the base portion including an inner cavity, an integral collar for inserting within the flexible sleeve open top end and a center channel formed through the inner cavity, the center channel axially aligning with the collapsible tube dispenser openable paste dispensing element.

2. The display apparatus according to claim 1, wherein the sleeve cap base and top portions are integrally attached by a hinge.

3. The display apparatus according to claim 1, further comprising a plurality of puncture holes formed in the flexible sleeve closed bottom end along a line perpendicular to the flexible sleeve longitudinal axis providing a means for releasing air from within the flexible sleeve.

4. The display apparatus according to claim 1, further comprising a hanger element disposed at a terminal portion of the flexible sleeve closed bottom end.

5. The display apparatus according to claim 4, further comprising a plurality of perforated cuts formed in the flexible sleeve closed bottom end along a line perpendicular to the flexible sleeve longitudinal axis, the perforated cuts providing a means for removing the hanger element.

6. The display apparatus according to claim 1, wherein the flexible support member comprises a pair of panels.

7. The display apparatus according to claim 6, wherein the flexible support member pair of panels are integrally attached by a hinge.

8. The display apparatus according to claim 1, further comprising an external support ring inserted over an outer circumference of the flexible sleeve open top end.

9. The display apparatus according to claim 8, wherein the support ring is flexible.

10. The display apparatus according to claim 1, wherein the sleeve cap center channel has an open top end and an open bottom end, the open top end permitting paste from the collapsible tube dispenser to flow therefromout, the open bottom end having a threaded portion formed along an inner circumference of the center channel for engaging reciprocal threads formed along an outer circumference of the collapsible tube dispenser openable paste dispensing element.

11. The display apparatus according to claim 10, wherein the sleeve cap base portion includes an upwardly extending cone-shaped nipple portion, the center channel open top end located at an apex of the upwardly extending cone-shaped nipple portion.

12. The display apparatus according to claim 11, wherein the sleeve cap top portion includes an internal cap portion mounted along an inner top wall of the sleeve cap top portion, the internal cap portion axially aligning with the center channel open top end when the sleeve cap top portion engages the sleeve cap base portion by friction fit.

13. The display apparatus according to claim 1, wherein the sleeve cap integral collar is inwardly tapered.

14. The display apparatus according to claim 1, wherein the display apparatus can enclose toiletry items chosen from the group consisting of a toothbrush, a tube of toothpaste, a container of dental-floss and a set of toothpicks.

15. A display apparatus for a collapsible tube dispenser having an openable paste dispensing element, the display apparatus comprising:

(a) a flexible transparent polymeric sleeve removably enclosing the collapsible tube dispenser, the sleeve having an open top end, a closed bottom end and a longitudinal axis running between the top and bottom ends, (b) a flexible polymeric support member having at least one panel removably positioned longitudinally within the sleeve, the support member providing a means for displaying indicia and pictures, (c) a sleeve cap engaging the collapsible tube dispenser, the sleeve cap having a base portion and a top portion, the base portion including an inner cavity, an integral collar for inserting within the flexible sleeve open top end and a center channel formed through the inner cavity, the center channel having opposed open top and bottom ends, the open bottom end having threads formed along an inner circumference of the center channel for engaging reciprocal threads disposed about an outer circumference of the collapsible tube dispenser openable paste dispensing element thereby axially aligning the collapsible tube dispenser openable paste dispensing element with the sleeve cap base portion center channel, the open top end permitting paste from the collapsible tube dispenser that enters into the center channel from the center channel open bottom end to flow therefromout, paste from the collapsible tube dispenser entering the center channel when external pressure is applied to the flexible sleeve, and (d) an external support ring inserted over an outer circumference of the flexible sleeve open top end.

16. The display apparatus according to claim 15, wherein the sleeve cap base and top portions are integrally attached by a hinge.

17. The display apparatus according to claim 15, wherein the sleeve cap base portion includes an upwardly extending cone-shaped nipple portion, the center channel open top end located at an apex of the upwardly extending cone-shaped nipple portion.

18. The display apparatus according to claim 17, wherein the sleeve cap top portion includes an internal cap portion mounted along an inner top wall of the sleeve cap top portion, the internal cap portion axially aligning with the center channel open top end when the sleeve cap top portion engages the sleeve cap base portion by friction fit.

19. The display apparatus according to claim 15, further comprising a plurality of puncture holes formed in the flexible sleeve closed bottom end along a line perpendicular to the flexible sleeve longitudinal axis, the plurality of puncture holes providing a means for releasing air from within the flexible sleeve.

20. The display apparatus according to claim 15, further comprising:

(a) a hanger element disposed at a terminal portion of the flexible sleeve closed bottom end, and (b) a plurality of perforated cuts formed in the flexible sleeve closed bottom end along a line perpendicular to the flexible sleeve longitudinal axis, the perforated cuts providing a means for removing the hanger element.

21. The display apparatus according to claim 15, wherein the flexible support member comprises a pair of panels integrally attached by a hinge.

* * * * *